US012157613B2

(12) United States Patent
Robison et al.

(10) Patent No.: US 12,157,613 B2
(45) Date of Patent: Dec. 3, 2024

(54) SELECTIVELY OPENABLE CLOSURE FOR A CONTAINER

(71) Applicant: Berry Global, Inc., Evansville, IN (US)

(72) Inventors: Jacob Brian Robison, Marietta, PA (US); Steven Daniel Gift, Lititz, PA (US); William Gregory Eisenbach, Lititz, PA (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 18/103,213

(22) Filed: Jan. 30, 2023

(65) Prior Publication Data

US 2023/0242306 A1 Aug. 3, 2023

Related U.S. Application Data

(60) Provisional application No. 63/304,217, filed on Jan. 28, 2022.

(51) Int. Cl.
*B65D 50/04* (2006.01)

(52) U.S. Cl.
CPC ..... *B65D 50/041* (2013.01); *B65D 2215/02* (2013.01)

(58) Field of Classification Search
CPC . B65D 2215/02; B65D 1/0246; B65D 50/041
See application file for complete search history.

(56) References Cited

U.S. PATENT DOCUMENTS

| | | | | |
|---|---|---|---|---|
| 3,843,006 | A * | 10/1974 | Naito | B65D 50/041 215/220 |
| 3,944,102 | A | 3/1976 | Grau | |
| 7,815,061 | B1 | 10/2010 | Robinson et al. | |
| 7,988,003 | B1 | 8/2011 | Clodfelter | |
| 8,534,476 | B2 | 9/2013 | Brozell | |
| 8,857,638 | B2 | 10/2014 | Brozell | |
| 11,116,693 | B2 | 9/2021 | Gift et al. | |
| 11,498,731 | B2 | 11/2022 | Lebon | |
| 2008/0164234 | A1 | 7/2008 | Rho | |
| 2015/0225135 | A1* | 8/2015 | Lonsway | B65D 51/1688 215/252 |
| 2016/0159533 | A1* | 6/2016 | Piscopo | B65D 50/041 215/202 |
| 2016/0251127 | A1 | 9/2016 | Faragher | |
| 2021/0171249 | A1 | 6/2021 | Aboabdo | |
| 2021/0179323 | A1* | 6/2021 | Kreinbrink | B65D 41/3428 |

FOREIGN PATENT DOCUMENTS

WO 2022180567 A1 9/2022

OTHER PUBLICATIONS

International Search Report and Written Opinion of corresponding international application No. PCT/US2023/011875 mailed Apr. 5, 2023.

* cited by examiner

*Primary Examiner* — Shawn M Braden

(57) ABSTRACT

A closure for a container, and more specifically a closure that is selectively openable and/or lockable providing, for example, one or more child resistant opening features is disclosed.

20 Claims, 10 Drawing Sheets

SELECTIVELY OPENABLE CLOSURE FOR A CONTAINER

PRIORITY CLAIM

This application claims priority under 35 U.S.C. § 119(e) to U.S. Provisional Application Ser. No. 63/304,217, filed Jan. 28, 2022, which is expressly incorporated by reference herein.

TECHNICAL FIELD

The present disclosure relates generally to a closure for a container, and more specifically to a closure that is selectively openable and/or lockable providing, for example, one or more child resistant opening features.

BACKGROUND

It is often desirable to make a container selectively openable by providing a closure for the container. For example, the closure may be selectively opened and closed and may include a locking or blocking feature that makes it more difficult or resistant to opening by a child.

SUMMARY

Certain embodiments according to the present disclosure provide a selectively openable closure for a container.

In one aspect, for instance, some embodiments may provide a closure that is resistant to opening by including two separate motions or user inputs to open. A closure may be provided that includes an inner shell having a top wall and an inner side wall depending from the top wall in a first axial direction. The inner shell may be configured to be rotationally attachable and removable from a container. The closure may also include an outer shell configured to be coupled to the inner shell. The outer shell may have a top and an outer side wall that depends from the top in the first axial direction. The outer side wall may be disposed radially outwardly of the inner side wall of the inner shell when the inner shell and outer shell are coupled. The inner shell may include a plurality of inner lugs on the top wall. The outer shell may include at least one petal configured to bias the outer shell in a second axial direction opposite the first axial direction from an engaged position toward a disengaged position in the absence of a first user input in the first axial direction. The first user input may, for example, be a downward push or force on the top of the outer shell or closure. Each petal of the at least one petal may have a top edge and a distal end, wherein the top edge is interposed between the top of the outer shell and the distal end, and wherein the distal end is disposed radially outward of the top edge. The petal may have a resting height when in the disengaged position in the first axial direction from the top edge to the distal end. The petal may have a compressed height when in the engaged position in the first axial direction from the top edge to the distal end, and the resting height of the petal may be greater than the compressed height of the petal. The outer shell may include a plurality of outer lugs configured to engage the plurality of inner lugs when the first user input is applied to the outer shell to provide the closure in an engaged position in which the at least one inner lug and at least one outer lug are in circumferential alignment and overlapping in the axial direction. The outer shell may be movable in the first axial direction from the disengaged position toward the engaged position and the at least one petal may be deformed when subject to the first user input.

BRIEF DESCRIPTION OF THE DRAWINGS

The detailed description particularly refers to the accompanying figures, in which.

DETAILED DESCRIPTION

Embodiments now will be described more fully hereinafter with reference to the accompanying drawings, in which some, but not all embodiments are shown. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
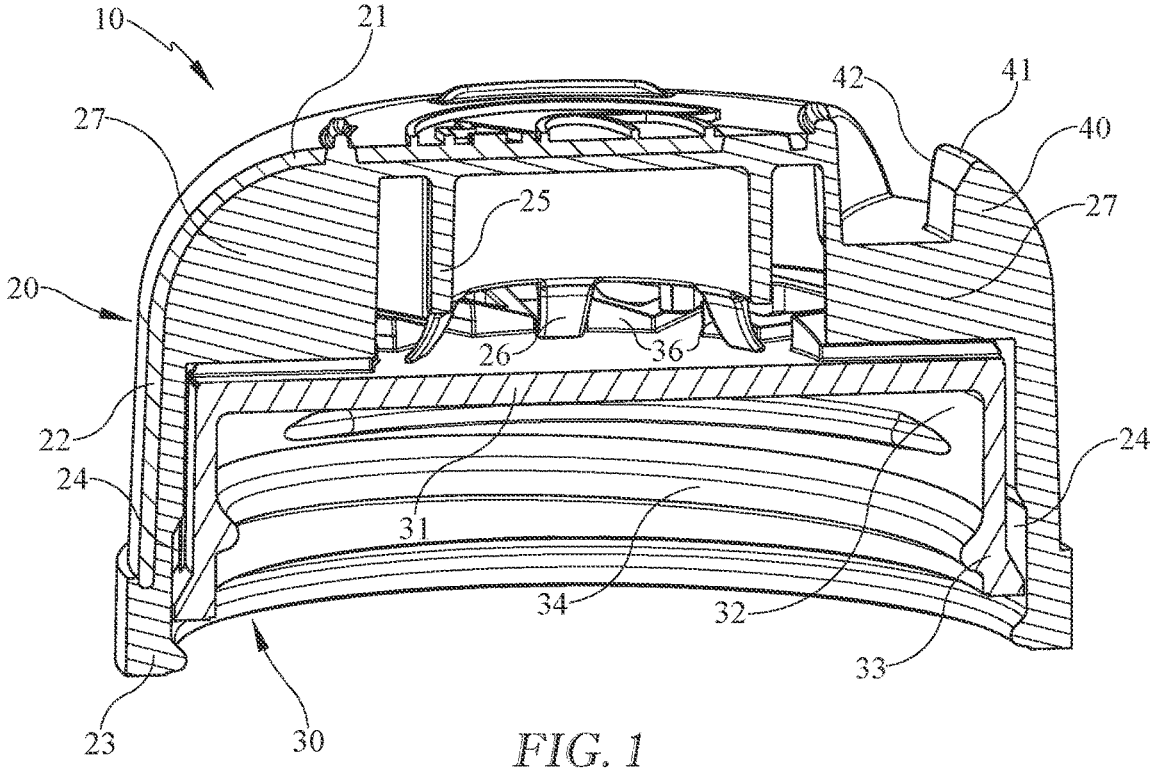
FIG. 1 illustrates a first cross-section perspective view of an exemplary embodiment of a child resistant, push and turn style, closure that includes an outer shell and an inner shell.
Figure 2:
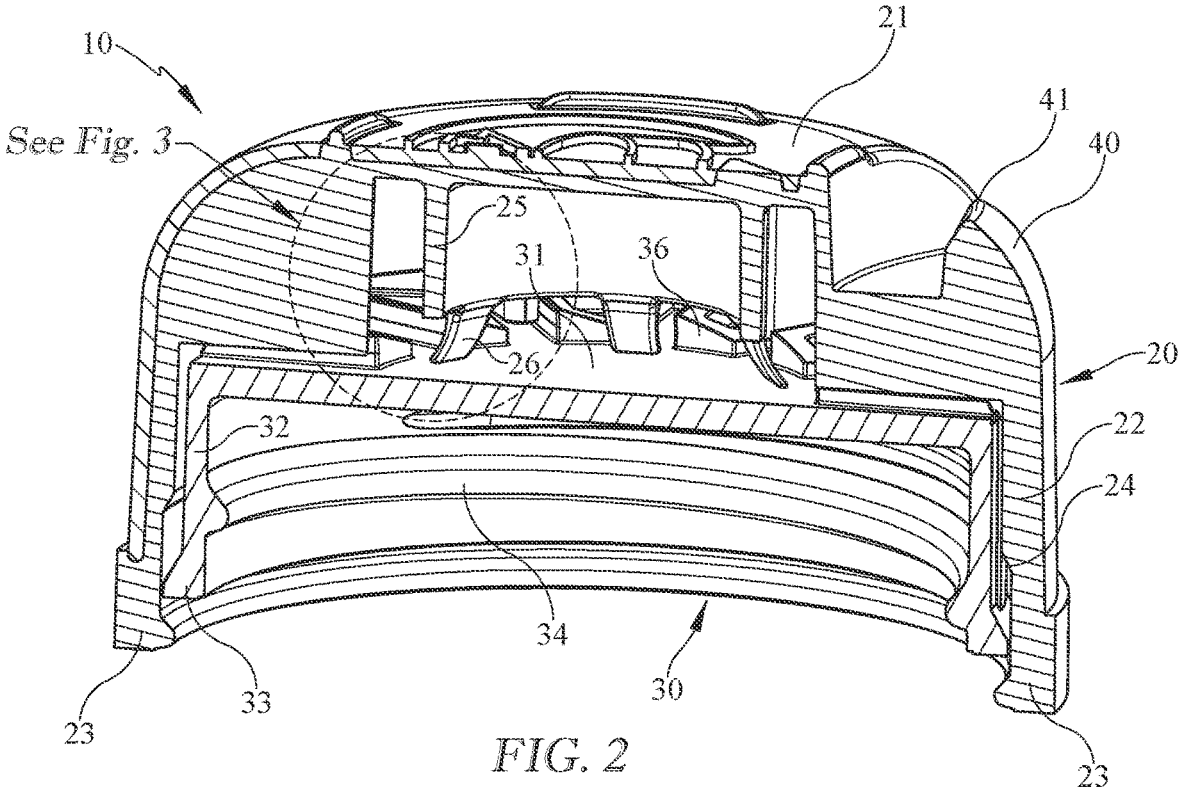
FIG. 2 illustrates a second cross-section perspective view of the closure of FIG. 1, shown in a resting or disengaged position in which little or no down force is applied to the outer shell such that outer lugs of the outer shell are not moved downward to engage inner lugs of the inner shell.

An embodiment of a two-piece closure 10 is shown in cross-section in FIGS. 1 and 2 having an outer shell 20 and an inner shell 30 that may be configured to provide a child-resistant, push and turn style, closure. Outer shell 20 may be movable relative to inner shell 30 in a vertical or axial direction between a resting or disengaged position and a compressed or engaged position. Outer shell 20 may be removable relative to inner shell 30 in a circumferential or rotational direction. Twisting or rotation of outer shell 20 may cause spinning of outer shell 20 relative to inner shell 30 while in the disengaged position absent a user input moving outer shell 20 toward inner shell 30 such as a downward push on a top 21 of outer shell 20. A user input such as a downward push on top 21 of outer shell 20 may move outer shell 20 downward and/or into the compressed or engaged position relative to inner shell 30 such that rotation of outer shell 20 may cause rotation of inner shell 30.

Inner shell 30 may include an internal thread 34, as shown for example in FIGS. 1 and 2, that may be configured to engage threads of a container or container neck such that inner shell 30 may be rotated in a first rotational direction to be removed from the container or container neck and/or rotated in a second rotational direction to be fastened to and/or couple to the container or container neck. In such a configuration, rotation of outer shell 20 would not cause rotation of inner shell 30 that would cause removal of inner shell 30 and/or closure 10 from the container while closure 10 is in the resting or disengaged position. In this configuration, depression of outer shell 20 relative to inner shell 30 into the engaged position would be required before closure 10 and/or inner shell 30 could be rotationally removed from the container. In this way, for example, closure 10 may be configured to require two different user inputs for removal from a container. For example, the first user input may include pushing or depressing outer shell 20 axially toward inner shell 30 in a first axial direction, and the second user input may include rotationally moving or twisting outer shell 20 and inner shell 30 about a central axis, in order to provide a child-resistant push and turn style closure.

As shown in FIGS. 1 and 2, inner shell 30 may include an inner side wall 32 extending downwardly from a top wall 31 toward an inner distal end 33. Internal thread 34 may be disposed on an inner surface of inner side wall 32. Outer shell 20 may include top 21 and/or an outer side wall 22 depending downwardly from top 21 toward an outer distal end 23. Inner distal end 33 may flare radially outwardly and/or outer distal end 23 may flare radially inwardly axially below a recess 24 formed in outer side wall 22. As shown in FIGS. 1 and 2, inner distal end 33 may be inserted into recess 24 in such a way that it may float axially up and down inside recess 24, thus allowing inner shell 30 to float axially up and down relative to outer shell 20. In this way, for example, closure 10 can accommodate for axial movement of outer shell 20 relative to inner shell 30 to allow closure 10 to move between the resting or disengaged position and the compressed or engaged position. Outer distal end 23 may flare radially inwardly to provide a stopping point to the aforementioned floating movement in the axial direction, and/or to prevent inner shell 30 from falling out of or separating from outer shell 20. Inner distal end 33 may include an angled upper surface and a relatively horizontal or radially outwardly extending lower surface, as shown in FIGS. 1 and 2, to facilitate insertion or "snapping in" inner shell 30 to outer shell 20 while resisting removal of inner shell 30 from outer shell 20. In this way, for example, inner shell 30 and/or outer shell 20 may be provided in a way that makes insertion, attachment, and/or coupling them relatively easy compared to removal of inner shell 30 from outer shell 20 after they have been attached and/or coupled.

FIGS. 1 and 2 show closure 10 in the resting or disengaged position. In the disengaged position, outer shell 20 may rotate relative to inner shell 30 without causing rotation of inner shell 30 sufficient to remove inner shell 30 from an underlying container to which it may be attached, for instance, by unthreading inner shell 30 from the container. Outer shell 20 may include one or more outer lugs 27, which may be configured to engage one or more inner lugs 36 of inner shell 30 when in the engaged position. In the disengaged position shown in FIGS. 1 and 2, closure 10 and/or outer shell 20 is in the absence of an external force in the axial direction downward or toward inner shell 30 that is sufficient to move outer shell 20 into the engaged position relative to inner shell 30. In the disengaged position, outer lugs 27 may be axially separated a sufficient distance, and/or out of circumferential alignment in a rotational direction, from inner lugs 36 and/or a front edges 361 of inner lugs 36 such that outer lugs 27 may freely rotate or move by inner lugs 36 without engagement of them. In the engaged position, outer shell 20 and/or outer lugs 27 may be moved axially toward inner shell 30 and/or inner lugs 36 a sufficient distance to bring outer lugs 27 into axially overlap and/or circumferential or rotational alignment with inner lugs 36 and/or front edges 361 of inner lugs 36. Outer lugs 27 and inner lugs 36 are discussed in more detail below, with outer lugs 27 shown in more detail in FIGS. 6 and 7 and inner lugs 36 shown in more detail in FIG. 16, for example.

One or more petals 26 on outer shell 20 may bias outer shell 20 toward the disengaged position such that the resting position is the disengaged position, as shown for example in FIGS. 1 and 2. Petals 26 may provide semi-resilient springing structures that may be deformed by sufficient force or pressure, such as a user's downward push or force on top 21, which may force petals 26 downwardly and/or against top wall 31 of inner shell 30 to cause the deformation. Petals 26 may extend downwardly from an inner ring 25. Inner ring 25, if included, may be centrally located on and/or coaxial with outer shell 20 and/or outer side wall 22. Inner ring 25 may extend downwardly from top 21 of outer shell 20 toward top wall 31 of inner shell 30 when outer shell 20 and inner shell 30 are coupled or attached. Inner ring 25 may be radially inward of outer lugs 27 and/or inner ring 25 may extend downwardly from top 21 of outer shell 20 a distance that is less than a distance that outer lugs 27 extend downwardly from top 21 such that inner ring 25 is shorter than outer lug 27. Petals 26 may be taller than inner lugs 36 and/or extend downwardly from inner ring 25 a distance that is greater than the distance that outer lug 36 extends upwardly from top wall 31 of inner shell 30.

Figure 3:
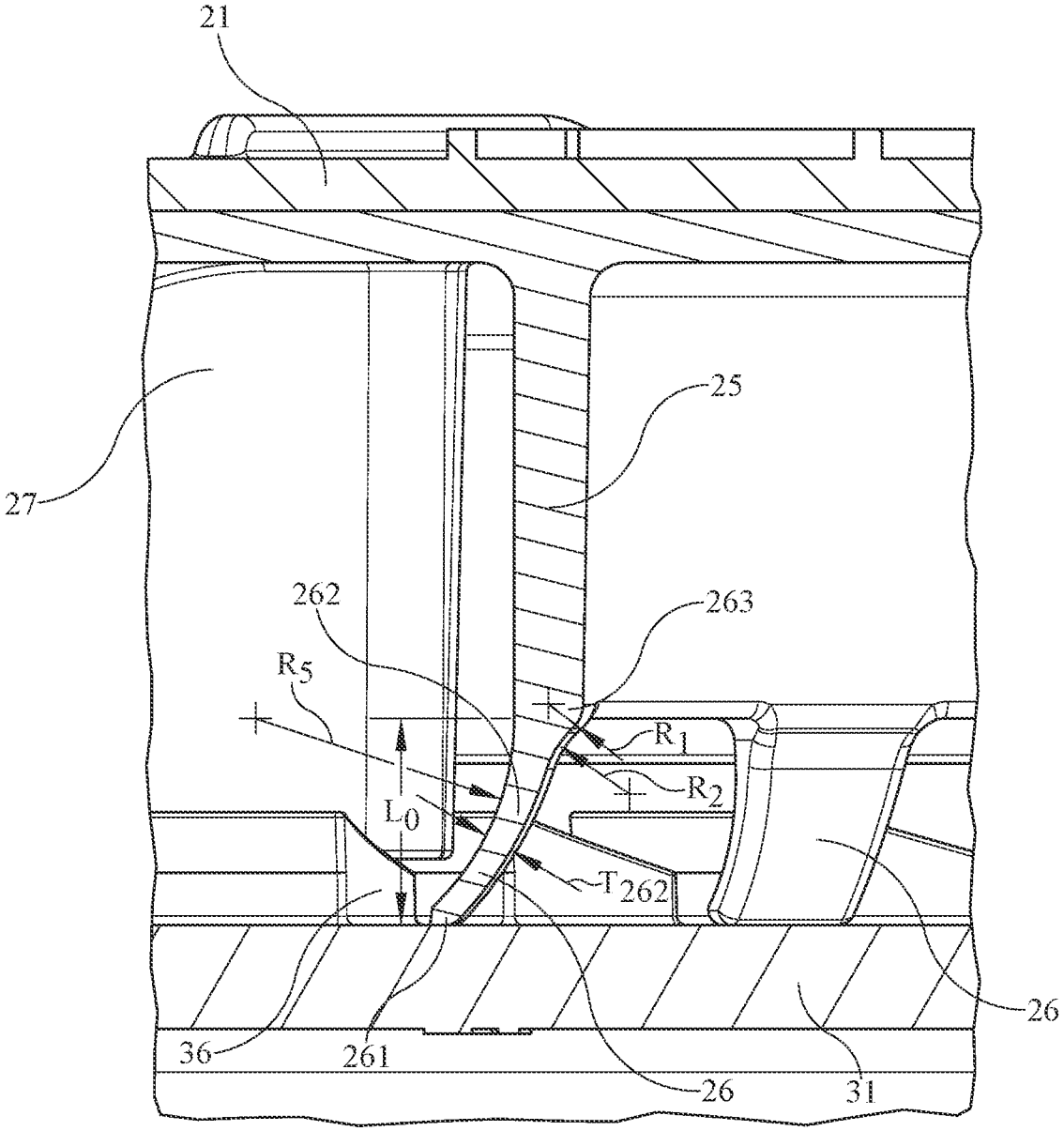
FIG. 3 illustrates a close up cross-section side view of a portion of the closure of FIG. 2 to show features, including petals, in more detail while in the resting or disengaged position.

Petal 26 is shown in more detail in cross section in FIG. 3, which illustrates petal 26 depending downwardly from a top edge 263 adjacent inner ring 25 of outer shell 20 toward a distal end 261 and having a petal body 262 disposed between top edge 263 and distal end 261. In some embodiments, petal 26 may have a radially outwardly curving profile, for example about a petal body radius of curvature, or fifth radius of curvature, $R_5$. Distal end 261 of petal 26 may be disposed radially outward of top edge 263 as provided by a curved shape of body 262, for example. In this exemplary configuration, one or more petals 26 may be provided having springing or spring-like capabilities. For example, petals 26 may be formed of a thermoplastic material that can be deformed but that tends to return to its original shape.

Petal 26 and/or petal body 262 may be thinner than inner ring 25, as shown for example in FIG. 3. Curved transitions such as a first curve $R_1$ having a first radius of curvature and a second curve $R_2$ having a second radius of curvature may be provided to transition the thickness from the thicker inner ring 25 down to the thinner petal body 262. First curve $R_1$ may curve in a first curve direction (e.g., radially outwardly or with a center point located radially outwardly) and second curve $R_2$ may curve in a second curve direction (e.g., radially inwardly or with a center point located radially inwardly) and/or in opposite directions with centers of curvature on opposite sides of the curved surface of petal 26 as shown for example in FIG. 3. First curve $R_1$ and/or second curve $R_2$ may be provided, for example, so that no right angles or corners are needed to transition thickness between inner ring 25 petal 26. In some embodiments, such right angles or corners could result in stress concentrations that make petals 26 more likely to crack, break, and/or fail when moved into the engaged position, as discussed in more detail below.

Closure 10 may be configured to provide a predetermined down force to move it into the engaged position from the disengaged position. A predetermined down force target may be, for example, between about 1 lb and about 8 lbs, between about 2 lbs and about 6 lbs, between about 3 lbs and about 5 lbs, between about 3.5 lbs and about 4.5 lbs, and/or about 4 lbs. It is understood that the predetermined target down force may vary depending on the intended application of closure 10. Petals 26 may be sized, shaped, oriented, configured, and/or provided in a number of petals intended to provide the predetermined down force sufficient to overcome the resistance and/or bias toward the resting or disengaged position.

In the exemplary embodiment shown in the figures, for example, six petals 26 are arranged equidistantly and circumferentially around the bottom, or distal end opposite top 21, of inner ring 25. Petal 26 extends radially outwardly as it extends axially away from inner ring 25, and/or from top edge 263 toward distal end 261 with an arced or curved body 262 that curves about outer radius of curvature $R_5$. Petal 26 may have a length $L_0$ in the axial direction from top edge 263 to distal end 261. Petal 26 may have a petal body thickness $T_{262}$ measured at petal body 262. Petal length $L_0$, petal body thickness $T_{262}$, and/or petal outer radius of curvature $R_5$ may be configured to provide a predetermined or target down force, for example, with consideration also to the number of petals 26, the width of petals 26, the geometry of petals 26, and/or the material constituting petals 26.

Continuing this example, resting petal length $L_0$, measured when petal 26 is at rest and not being compressed or depressed, was about 0.12 inches, outer radius of curvature $R_5$ was about. 0.22 inches, and petal body thickness $T_{262}$ was about 0.016 inches. In this example, it was found that six petals 26 spaced equally around the bottom of inner ring 25 provided a resistance to a down force (in the axial direction from top 21 of outer shell 20 toward top wall 31 of inner shell 30) of about 4 lbs. It is understood that these measurements may vary somewhat and still provide a similar down force or may be varied to vary the down force needed to move closure 10 from the resting or disengaged position to the compressed or engaged position.

Figure 4:
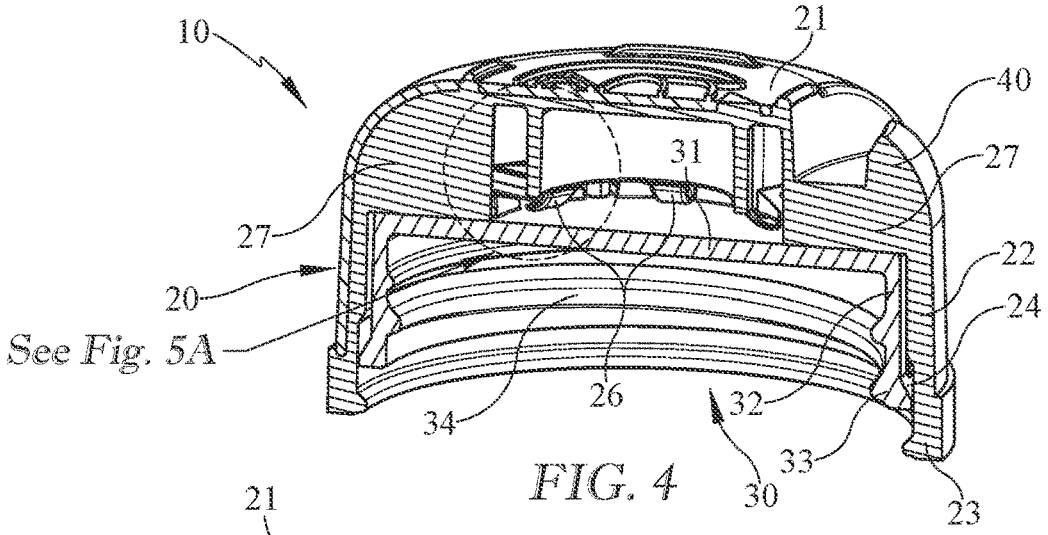
FIG. 4 illustrates the closure of FIG. 1 now shown in a compressed or engaged position in which force is applied to move the outer shell toward the inner shell such that the outer lugs are moved downward to engage the inner lugs.
Figure 5A:
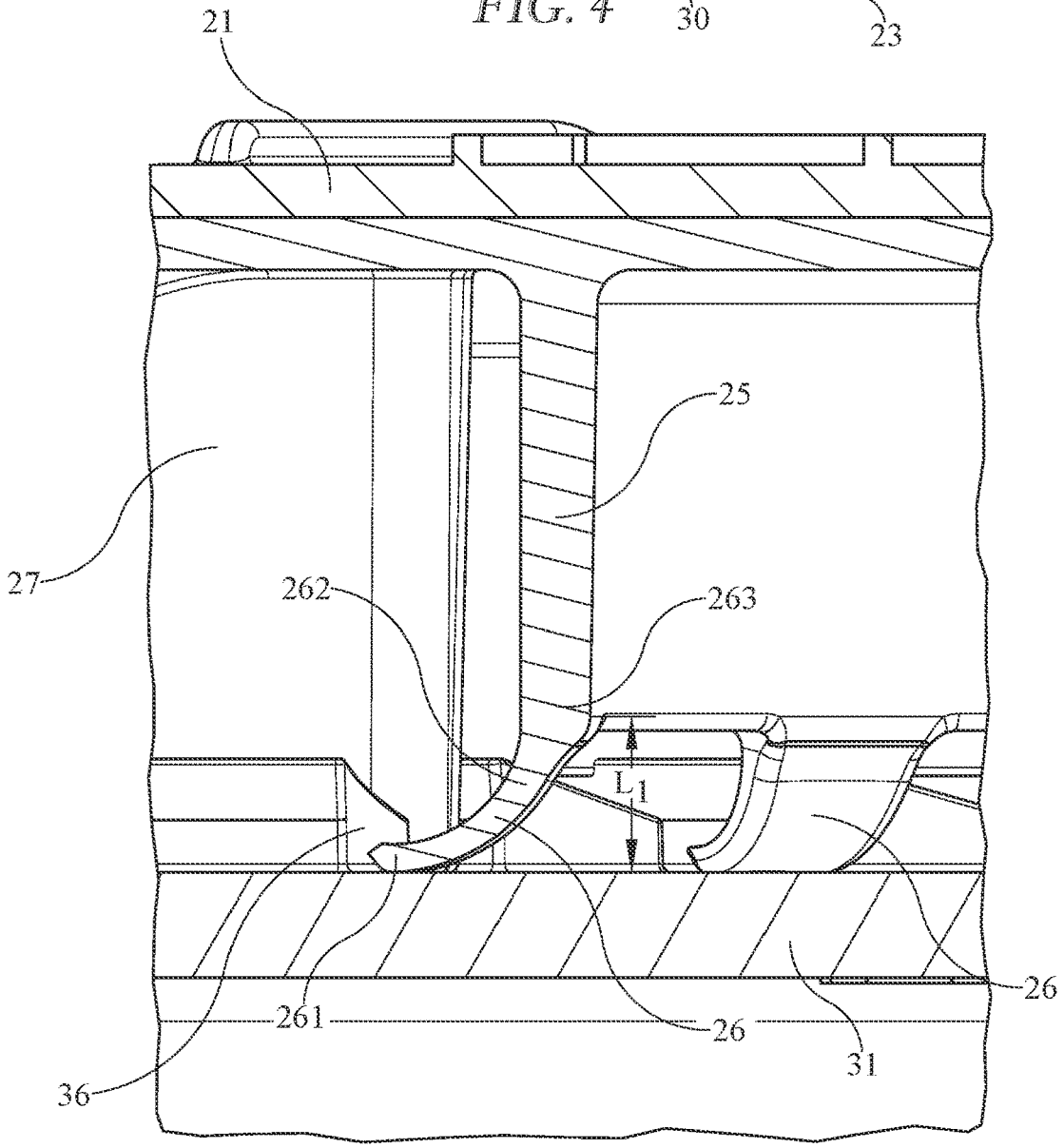
FIG. 5*a* illustrates a close up cross-section side view of a portion of the closure of FIG. 5 to show features, including petals, in more detail while in the compressed or engaged position.
Figure 5B:
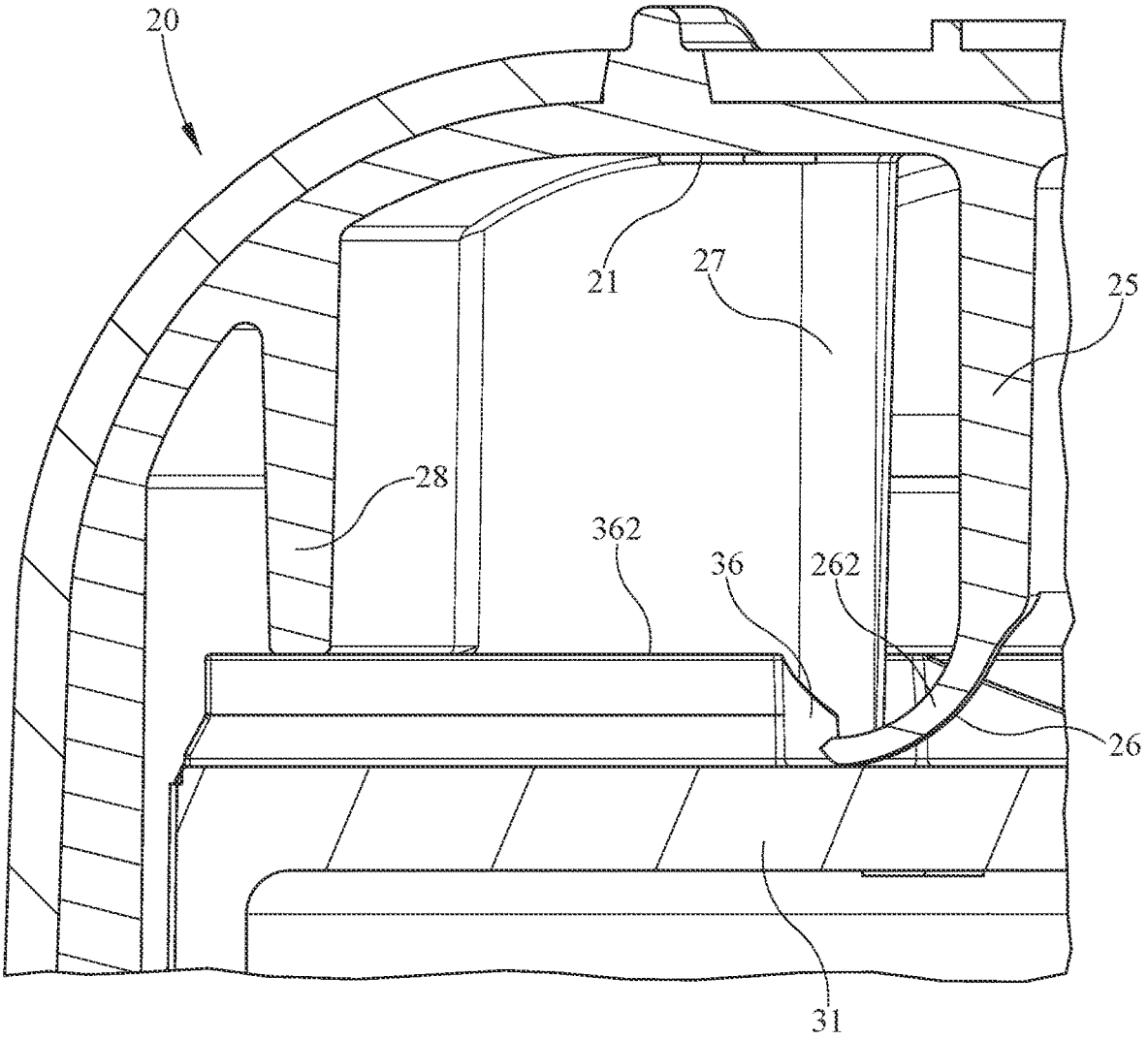
FIG. 5*b* illustrates a close up view of another portion of the closure of FIG. 4 to show a portion of the outer shell contacting a portion of the inner shell to prevent further compression of the petals.

Closure 10 is shown in a compressed or engaged position, for example, in FIGS. 4, 5A, and 5B, with outer shell 20 moved in the axial direction downward or toward inner shell 30. In use, closure 10 may be attached or coupled to a container or bottle, for example via internal thread 34, and the container or bottle underlying inner shell 30 may prevent or resist axial movement in a downward direction opposite top 21 of outer shell 20, such that when outer shell 20 is compressed, depressed, and/or pushed down upon, it will move toward inner shell 30 with spring-like resistance provided by the compression or deformation of petals 26 to bias outer shell 20 back toward the resting position.

In the compressed or engaged position, when outer shell 20 is rotated in a first rotational direction relative to inner shell 30, for example, when outer shell 20 is rotated counterclockwise (CCW) relative to inner shell 30 in the configuration shown in FIG. 4A, a relatively vertical or axially extending face of outer lug 27 may contact a relatively vertical or axial face on a low front edge 361 of lug 36 (see, e.g., FIG. 16, which is discussed more below), thus forming a mechanical stop and causing CCW rotation of inner shell 30, which may be used to unthread and/or remove inner shell 30 and thus closure 10 from an underlying container. In this way, for example, a first input, compression or depression of outer shell 20, may allow a second input, rotational movement of outer shell 20 to cause removal of closure 10 from a container, and/or to allow a user to gain access to the container under closure 10. In the absence of the first input, the depression of outer shell 20, CCW rotation of outer shell 20 relative to inner shell 30 would result in outer lugs 27 riding over the ramped or cam upper surface of lugs 36, or missing them altogether, thus not causing CCW rotation of inner shell 30, in which case a user would not be able to remove closure 10 from the underlying container. Inner lug 36 may be provided with a high rear edge 362 of sufficient height to from the mechanical stop with outer lug 27 even in the absence of the first user input such as down force. If so, rotation in the second rotational direction opposite the first rotational direction (e.g., clockwise or CW rotation) may still result in rotation of the inner shell 30 caused by CW rotation of the outer shell 20 (if CCW is the removal direction) because outer lug 27 would abut and push high rear edge 362 of lug 36 even if closure 10 is in the resting position. In this way, closure 10 may be threaded and/or rotationally coupled to an underlying container by movement in the second rotational direction with or without the first user input or down force being applied.

As closure 10 and/or outer shell 20 moves from the resting or disengaged position toward the compressed or engaged position, petal 26 and/or distal end 261 may move or slide radially outwardly while the height of petal 26 in axial direction decreases to a compressed petal length $L_1$, as shown for example in FIG. 5A, when in the compressed or engaged position. While in the compressed or engaged position, petal 26 may try to return to its original or resting position and in doing so may provide a spring-like force biasing petal 26, and therefore inner ring 25 and/or outer shell 20, upward relative to top wall 31 of inner shell 30 as petal 26 pushes against top wall 31 of inner shell 30. In the example discussed above, in which the resting length $L_0$ of petal 26 is about 0.12 inches, the compressed, compressed, or engaged length $L_1$ of petal 26 is about 0.09 inches (i.e., the height of petal 26 in the axial direction is reduced by about 0.03 inches).

In order to help prevent overly depressing or compressing petal 26, in which case it could weaken to the point of losing its upward biasing capability and/or crack or break, or for any other reason, closure 10 may be provided with features to stop axial movement in the first direction or downward direction of outer shell 20 relative to inner shell 30. For example, as shown in FIGS. 5A and 5B, outer lug 27 may have a sufficient height that it contacts top wall 31 of inner shell 30 and/or outer lug(s) 36 to form a mechanical stop that prevents further depression or compression of petal 26. Instead of or in addition to outer lugs 27 being configured to abut inner shell 30 or any portion thereof, or for any other reason, an outer ring 28 may be provided to abut inner lugs 36 and/or inner shell 30. As shown for example in FIG. 5B, outer ring 28 may extend axially downwardly relative to outer shell 20 and/or top 21 of outer shell 20, and/or may extend circumferentially about a central axis of outer shell 20. Outer ring 28 may be disposed between outer side wall 22 and inner ring 25 in the radial direction that is transverse to the axial direction, and/or it may be substantially concentric and/or coaxial with outer side wall 22 and/or inner ring 25.

As shown for example in FIG. 5B, outer lug 27 may extend axially in a first axial direction (e.g., downwardly) a greater distance than outer ring 28, and/or outer ring 28 may extend in the first axial direction a greater distance than inner ring 25. Such a configuration may allow for provision of a sufficiently flexible but resilient petal 26 while also allowing for the aforementioned mechanical stop(s) provided by interaction of outer lugs 27 and top wall 31 and/or inner lugs 36, and/or by interaction of outer ring 28 and inner lugs 36, for example.

Figure 6:
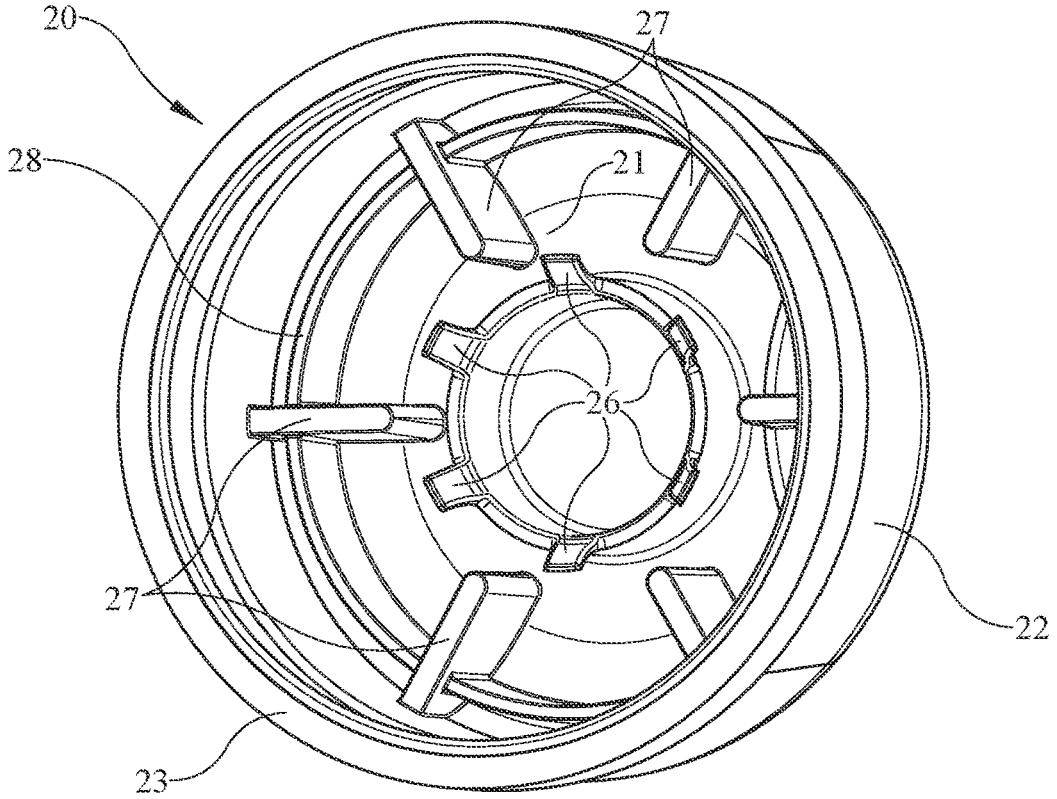
FIG. 6 illustrates a bottom perspective view of the outer shell of FIG. 1.
Figure 7:
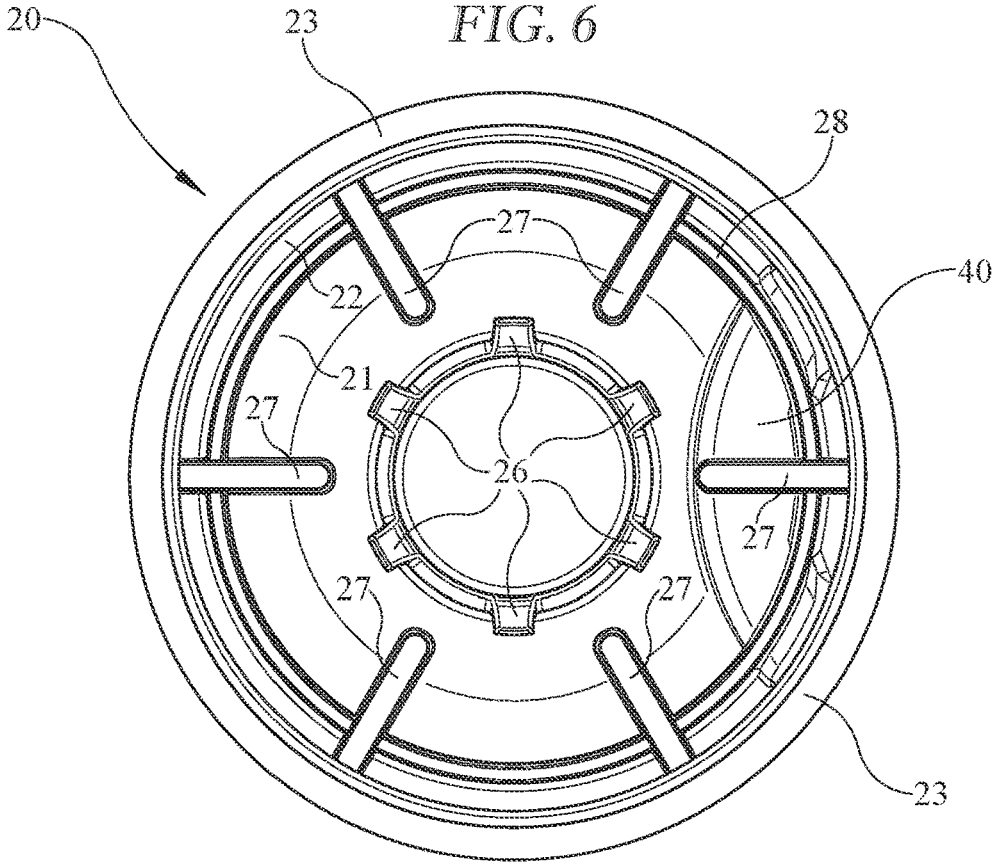
FIG. 7 illustrates a bottom plan view of the outer shell of FIG. 4.

Outer ring 28 and other features of outer shell 20 are shown in more detail in FIGS. 6 and 7. Outer ring 28 may be substantially continuous circumferentially, although it is understood that it may be provided with gaps or breaks. If continuous circumferentially, a smooth lower surface may be provided for consistent and predictable interaction with outer lugs 36, which may vary in height in the axial direction as they extend circumferentially, as discussed more below. Outer ring 28 may have a constant height and/or extend a distance from the top 21 of outer shell 21 a distance that is substantially constant for its circumferential length.

Petals 26 and/or outer lugs 27 may be arranged circumferentially and/or be spaced equidistantly, as shown for example in FIG. 7, which shows six petals 26 disposed at 60 degree increments as measured center to center as well as six outer lugs 27 also disposed at 60 degree increments as measured center to center. As shown in FIG. 7, petals 26 and outer lugs 27 may be arranged in a circumferentially alternating pattern, with each petal 26 positioned angularly and/or circumferentially about halfway between two adjacent outer lugs 27, and/or with each outer lug 27 positioned angularly and/or circumferentially about halfway between two adjacent petals. For example, with reference to the orientation shown in FIG. 7, a first petal 26 at the top of the drawing is located at 0 degrees, at 30 degrees is a first outer lug 27, at 60 degrees is a second petal 26, at 90 degrees is a second outer lug 27, at 120 degrees is a third petal 26, at 150 degrees is a third outer lug 27, at 180 degrees is a fourth petal 26, at 210 degrees is a fourth outer lug 27, at 240 degrees is a fifth petal 26, at 270 degrees is a fifth outer lug 27, at 300 degrees is a sixth petal 26, and at 330 degrees is a sixth outer lug 27, before returning to 0 degrees or 360 degrees to the first petal 26. This circumferentially symmetrical arrangement, alternating between petals 26 and outer lugs 27, may provide a symmetrical configuration and thus be independent of angularly orientation of outer shell 20 relative to inner shell 30, although it is understood that petals 26 and outer lugs 27 may be aligned rather than alternating, may be other than equally spaced, may be other than symmetrical, and need not be present in the same number (e.g, six of each as shown in FIG. 7) so that there are either more petals 26 than outer lugs 27 or there are more outer lugs 27 than petals 26, and more or less than six petals 26 and/or more or less than six outer lugs 27 may be used.

Through extensive testing, including finite element analysis (FEA) and physical testing, it was found that, although the predetermined or target down force was achieved, petals 26 would fail or were likely to fail with angles or corners having higher stress concentrations than gradual or curved transitions. For example, through experimentation and testing, it was found that in order to decrease the likelihood of failure, some or all corners or right angles could be removed from petals 26 and/or petals 26 may have radii of curvature at first curve $R_1$ and/or second curve $R_2$ (discussed above with reference to FIG. 3), at first curved fillet 264 and/or second curved fillet 265, and/or at third curve $R_3$ and/or fourth curve $R_4$. First curve $R_1$, second curve $R_2$, third curve $R_3$, fourth curve $R_4$, first curved fillet 264, and/or second curved fillet 265 may have radii of curvature providing a gradual transition and/or eliminating corners or angles (e.g., right angles or nearly right angles) that may concentrate stresses and may lead to premature failure of petals 26.

Figure 8:
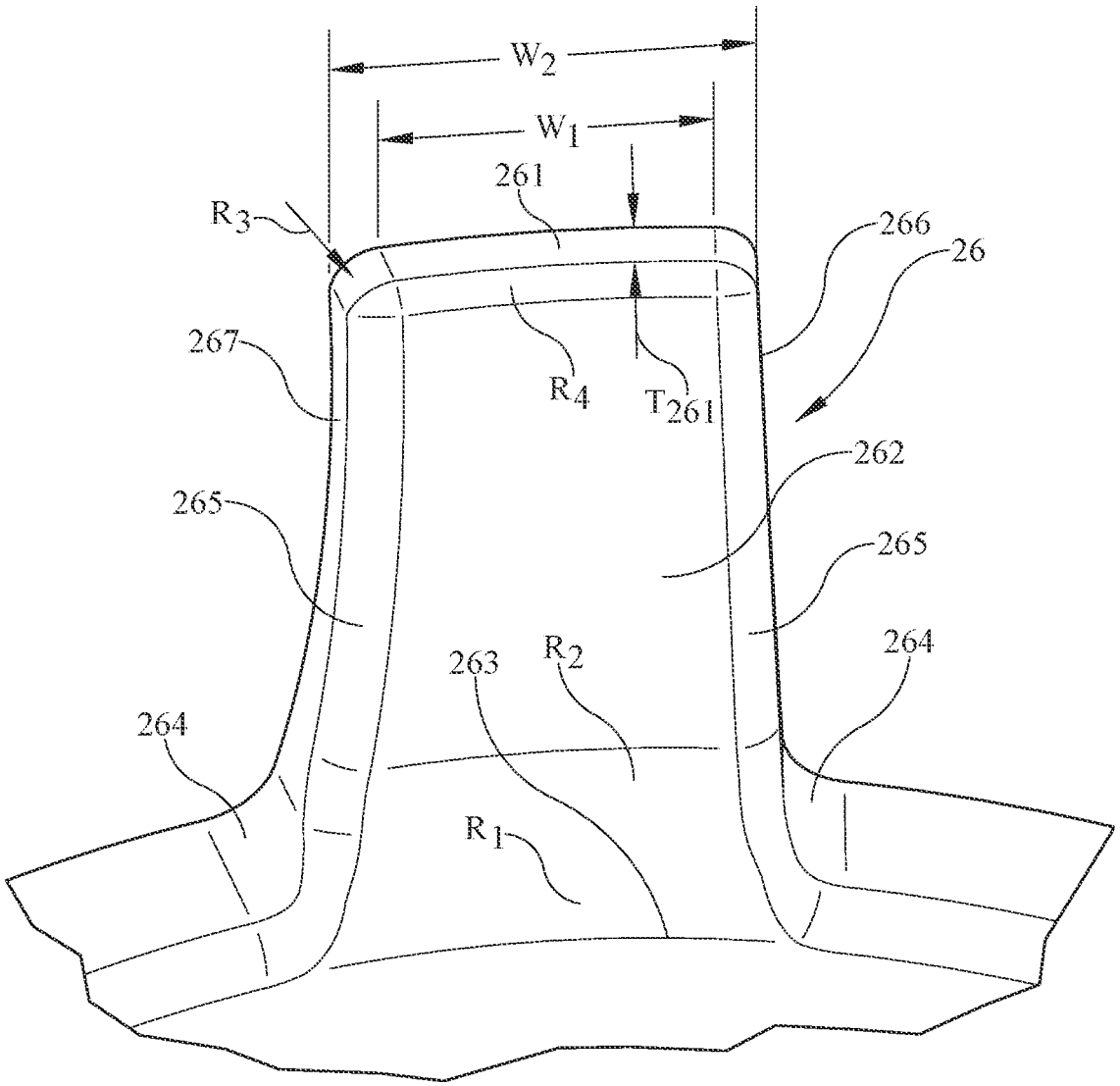
FIG. 8 illustrates a close-up perspective view of a petal of the closure of FIG. 1, shown in the resting or disengaged position.
Figure 9:
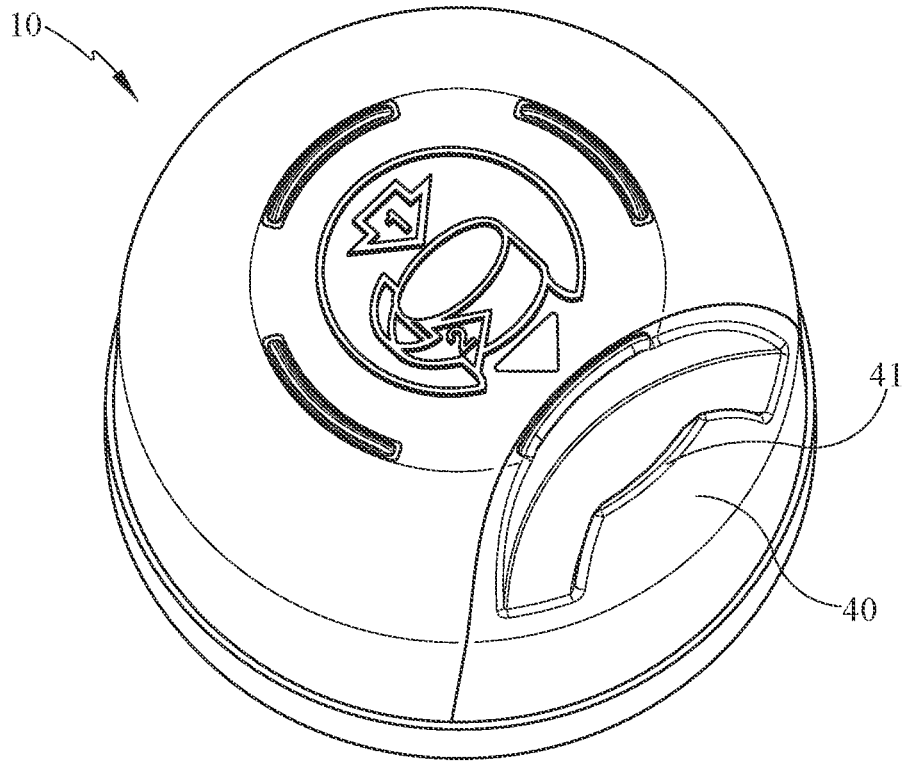
FIG. 9 illustrates a top perspective view of the outer shell of FIG. 1.
Figure 10:
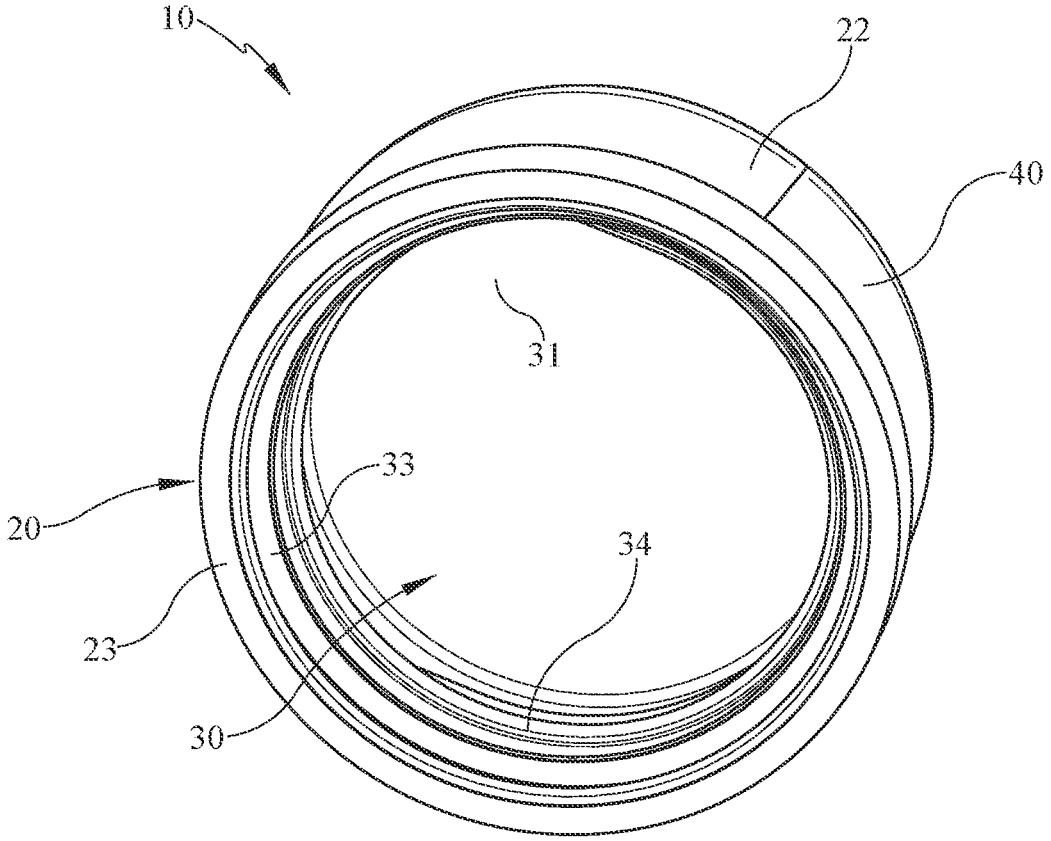
FIG. 10 illustrates a bottom perspective view of the closure of FIG. 1.
Figure 13:
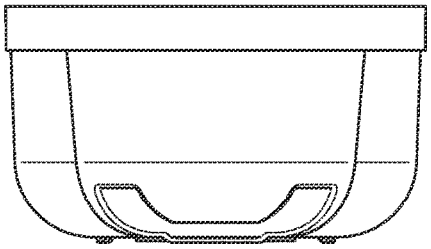
FIG. 13 illustrates a second side view of the outer shell of FIG. 11.
Figure 14:
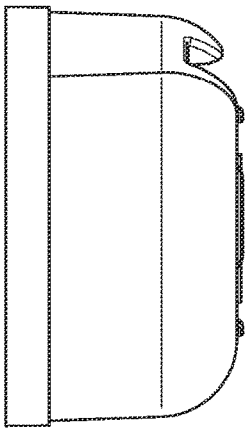
FIG. 14 illustrates a third side view of the outer shell of FIG. 11.
Figure 11:
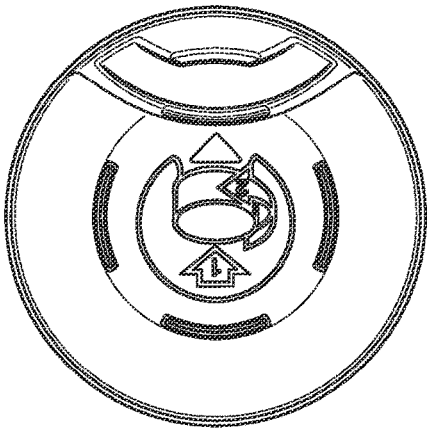
FIG. 11 illustrates a top plan view of the outer shell of FIG. 1.
Figure 15:
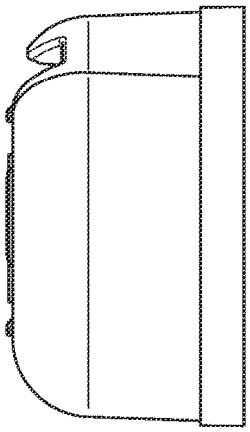
FIG. 15 illustrates a fourth side view of the outer shell of FIG. 11.
Figure 12:
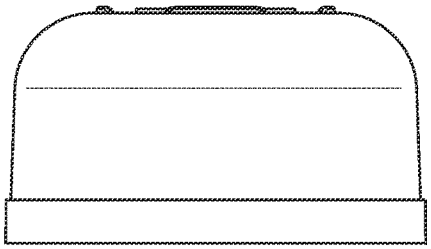
FIG. 12 illustrates a first side view of the outer shell of FIG. 11.

As shown in FIG. 8, petal 26 may have first curve $R_1$ at or near top edge 263 and/or second curve $R_2$ interposed between $R_1$ and petal body 262. First fillet 264 may provide a gradual or curved transition from inner ring 25 to a first petal side 266 and/or a second petal side 267. Second fillet 265 may provide a gradual or curved transition between first petal side 266 and a radially inward side of petal 26 and/or between second petal side 267 and the radially inward side of petal 26. Third curve $R_3$ may provide a gradual or curved transition between petal first side 266 and distal end 261 and/or between petal second side 267 and distal end 261. Fourth curve $R_4$ may provide a gradual or curved transition between the radially inward side of petal 26 and distal end 261. Distal end 261 may have a thickness $T_{261}$ between the radially inward side and a radially outward side of petal 26. Distal end 261 may have a first width $W_1$ in the circumferential direction that does not include third curve $R_3$ or distal end 261 may have a second width $W_2$ in the circumferential direction that does include two third curves $R_3$. The width of petal 26 at or near top edge 263 may be about 0.13 inches, which may include either or both first fillet 264.

Continuing the example discussed above with exemplary dimensions of petal 26, distal end thickness $T_{261}$ may be about 0.014 inches, first width $W_1$ may be about 0.07 inches, second width $W_2$ may be about 0.09 inches, first curve $R_1$ may be about 0.020 inches, second curve $R_2$ may be about 0.050 inches, third curve $R_3$ may be about 0.010 inches, fourth curve $R_4$ may be about 0.010 inches, first fillet 264 may be about 0.015 inches, and/or second fillet 264 may be about 0.010 inches. In this example, regarding the radii of curvature, for instance, third curve $R_3$, fourth curve $R_4$, and/or second fillet 265 may have approximately equal radii, which may be less than the radius of first fillet 264, which may be less still than the radius of first curve $R_1$, which may yet still be less than the radius of curvature of second curve $R_2$.

The exemplary dimensions in the example continued above, it was found, may be used when using polypropylene having a tensile yield strength of 5400 psi. The resulting design of petal 26 using this material, in the number and configuration described above and shown in the several figures, resulted in petal 26 that accommodated about 0.020 inches of axial depression or compression and provided a force in the opposite axial direction of about 4 lbs. Moreover, the aforementioned fillets and radii of curvature helped reduce stress concentrations resulting from the depression of petals 26 such that the resultant pressure was below the tensile yield strength of 5400 psi. Physical testing confirmed petals 26 did not fail when used as intended, and FEA indicated the maximum resulting pressure on any area of petals 26 or outer shell 30 was about 5000 psi and thus below the tensile yield strength of the polypropylene that was injection molded to form outer shell 20. FEA indicated that, for the example described above, without the aforementioned radii and fillets, stresses of 6300 psi or more were likely to result.

Additional views of closure 10 are illustrated in FIGS. 9-15. Closure 10 may include a cutting tool 40 as shown for example in FIG. 9. Cutting tool 40 may include, for example, a relatively sharp point or edge 41 and/or an inner surface 42 that may be suitable for piercing, puncturing, and/or cutting a seal, film, liner, or the like that may be included with the container underlying closure 10. Inner shell 30 may nest inside outer shell 20 to obscure the mechanical locking and/or unlocking features for example, or for any other reason, or for any combination of reasons, as shown for example in FIG. 10.

Inner shell 30 is shown in additional detail in FIGS. 16-19. As shown for example in FIG. 16, inner shell 30 may include a plurality of inner lugs 36 disposed on or near top wall 31. Any or all inner lugs 36 may include a ramped or cam shape, with a relatively low front edge 361 and a relatively high rear edge 362, for example, and as discussed more above. The high rear edge 362 may catch outer lugs 27 when rotated in the second rotational direction (e.g., CW) while in the disengaged position such that inner shell 30 may be tightened to a container or container neck absent a downward push force. The low front edge 361 and ramped surface of lug 36 may allow free spinning of outer shell 20 when rotated in the first rotational direction (e.g., CCW), which may be opposite the second rotational direction, absent the downward push force. Inner lug(s) 36 may extend from a radially inward side 363 radially outwardly toward a radially outward side 364. In some embodiments, inner lug 36 may be provided with a recess 365 in the top surface for any of a variety of reasons, including but not limited to reducing the weight of inner shell 30 and/or helping to prevent friction, suction or other forces from impeding rotation of outer shell 20 relative to inner shell 30.

Figure 16:
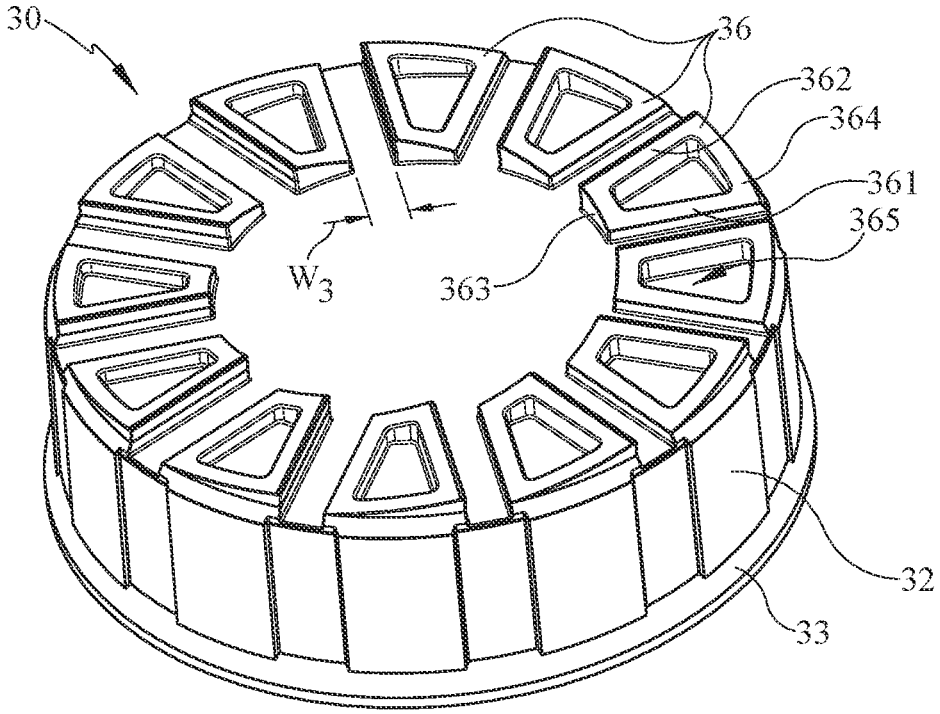
FIG. 16 illustrates a top perspective view of the inner shell of FIG. 1.
Figure 17:
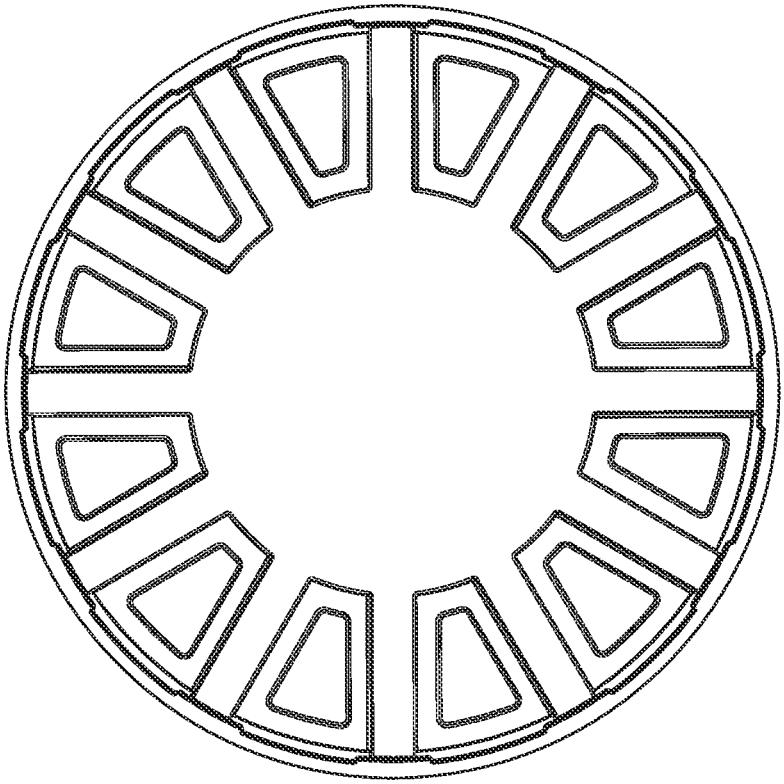
FIG. 17 illustrates a top plan view of the inner shell of FIG. 16.
Figure 18:
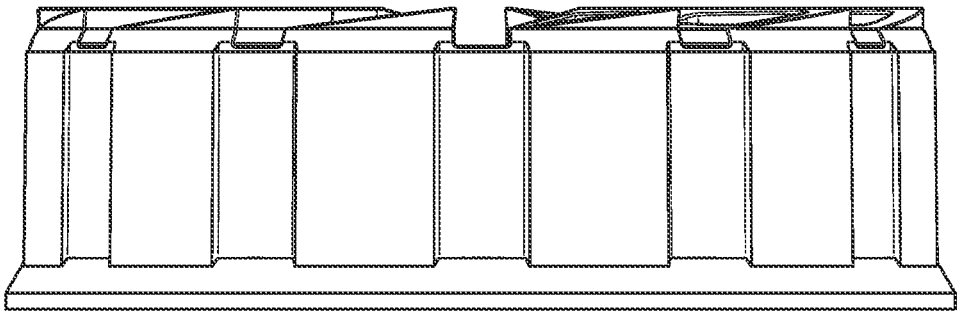
FIG. 18 illustrates a side elevation view of the inner shell of FIG. 16.
Figure 19:
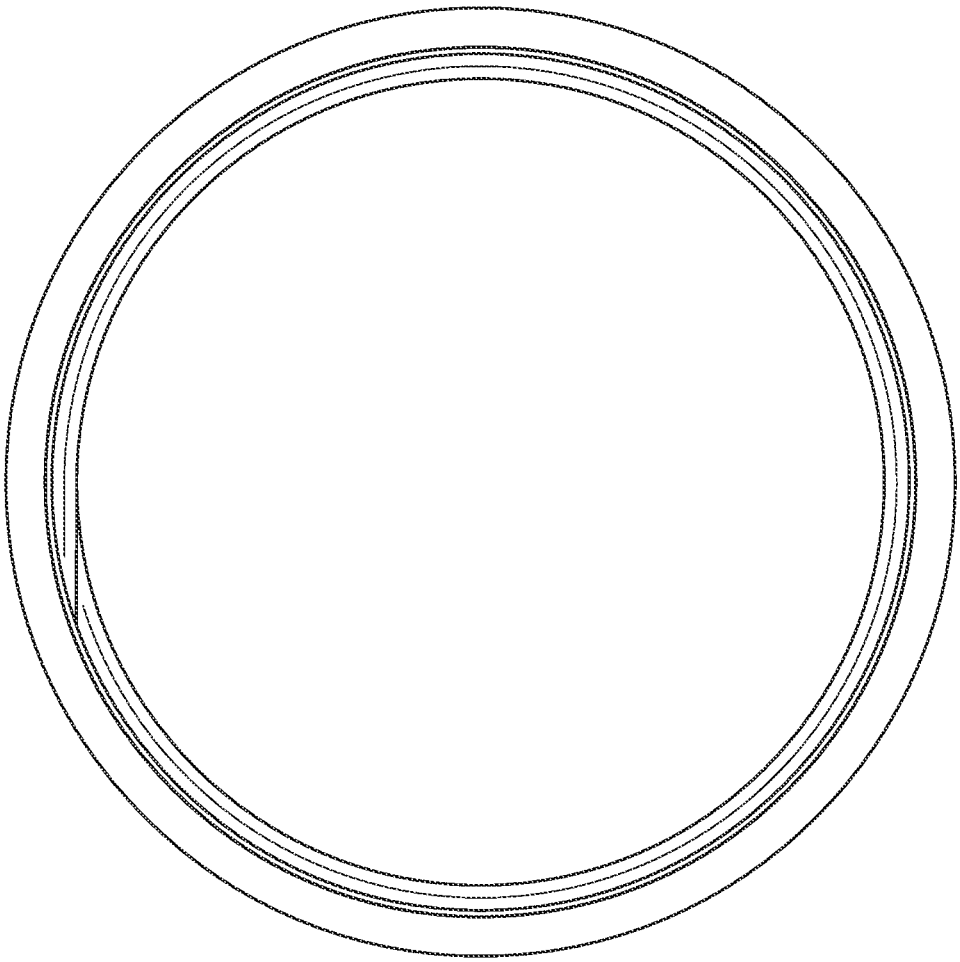
FIG. 19 illustrates a bottom plan view of the inner shell of FIG. 16.

In some embodiments, first width $W_1$ and/or second width $W_2$ of distal end 261 of petal 26 may be greater than a third width $W_3$ of a gap between front edge 361 and rear edge 362 of adjacent inner lugs 36, as shown for example in FIG. 16. Providing a gap width or third width $W_3$ of the gap between lugs 36 that is less than first width $W_1$ and/or second width $W_2$ may help prevent and/or inhibit distal end 261 from entering and/or getting stuck in the gap between two adjacent inner lugs 36.

It is understood that closure 10 and/or any component thereof may be made of any of a variety of materials, including, but not limited to, any of a variety of suitable plastics material, any other material, or any combination thereof. Suitable plastics material may include, but is not limited to, polyethylene terephthalate (PET), polyethylene (PE), polypropylene (PP), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that closure 10 or any component thereof may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of closure 10.

It is further understood that any of a variety of processes or combination thereof may be used to form closure 10, any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. Various materials and/or processes may be used to form closure 10 and/or any component thereof as will be understood by one of ordinary skill in the art.

Further still, it is understood that, while some directional terms are used herein, such as top, bottom, upper, lower, inward, outward, upward, downward, etc., these terms are not intended to be limiting but rather to relate to one or more exemplary orientations, positions, and/or configurations of closure 10, outer shell 20, inner shell 30, and/or any component thereof. For example, closure 10 may be oriented so that top 21 of outer shell 20 is substantially located at or above other components of closure 10, outer shell 20, and/or inner shell 30. This may be a typical orientation of some embodiments of closure 10. In general, this is the orientation that directional language used herein is directed for ease of reference and understanding. It is understood that closure 10, outer shell 20, and/or inner shell 30, and/or any component of thereof, may be oriented differently so that, for example, a different portion of closure 10 (other than top 21 of outer shell 20) is on top or at the highest extreme in the vertical or axial direction. For example, closure 10 may be oriented upside-down relative to the previously described orientation such that top 21 of outer shell is on the bottom or at the lowest extreme in the vertical or axial direction. Closure 10 may be provided in any of a number of different orientations.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A closure, comprising:

an inner shell having a top wall and an inner side wall depending from the top wall in a first axial direction, the inner shell configured to be rotationally attachable and removable from a container;

an outer shell configured to be coupled to the inner shell, the outer shell having a top and an outer side wall that depends from the top in the first axial direction, the outer side wall disposed radially outwardly of the inner side wall of the inner shell when the inner shell and outer shell are coupled;

wherein the inner shell includes a plurality of inner lugs on the top wall;

wherein the outer shell includes at least one petal configured to bias the outer shell in a second axial direction opposite the first axial direction from an engaged position toward a disengaged position in the absence of a first user input in the first axial direction;

wherein each petal of the at least one petal has a top edge and a distal end, wherein the top edge is interposed between the top of the outer shell and the distal end, and wherein the distal end is disposed radially outward of the top edge;

wherein the at least one petal has a resting height when in the disengaged position in the first axial direction from the top edge to the distal end, the at least one petal has a compressed height when in the engaged position in the first axial direction from the top edge to the distal end, and the resting height of the at least one petal is greater than the compressed height of the at least one petal;

wherein the outer shell includes a plurality of outer lugs configured to engage the plurality of inner lugs when the first user input is applied to the outer shell to provide the closure in the engaged position in which the at least one inner lug and at least one outer lug are in circumferential alignment and overlapping in the axial direction; and wherein the outer shell is movable in the first axial direction from the disengaged position toward the engaged position and the at least one petal is deformed when subject to the first user input.

2. The closure of claim 1, wherein the at least one petal has a curved shape with a petal body radius of curvature.

3. The closure of claim 2, wherein the petal body radius of curvature has a center point radially outward of the petal body.

4. The closure of claim 1, further comprising an inner ring depending in the first axial direction from the top of the outer shell, wherein the at least one petal has a top edge adjacent the inner ring, and the at least one petal depends in the first axial direction from the inner ring toward a distal end opposite the top edge of the petal.

5. The closure of claim 4, wherein the petal includes a petal body interposed between the top edge and the distal end, wherein the petal body has a petal body thickness and the inner ring has an inner ring thickness, and wherein the inner ring thickness is greater than the petal body thickness.

6. The closure of claim 5, wherein a transition in thickness from the inner ring thickness to the petal body thickness includes a first curve having a first radius of curvature.

7. The closure of claim 6, wherein the transition in thickness from the inner ring thickness to the petal body thickness includes a second curve having a second radius of curvature, wherein the first curve is interposed between the inner ring and the second curve.

8. The closure of claim 7, wherein the second radius of curvature is greater than the first radius of curvature.

9. The closure of claim 8, wherein the at least one petal has a curved shape with a petal body radius of curvature that is greater than the first radius of curvature and the second radius of curvature.

10. The closure of claim 1, wherein each inner lug of the plurality of inner lugs has a low front edge and high rear edge, wherein the low front edge is shorter in the first axial direction than the high rear edge, wherein the high rear edge of a first inner lug is adjacent the low front edge of a second inner lug that is adjacent the first inner lug, and wherein the high rear edge of the first inner lug is separated from the low front edge of the second inner lug by a gap having a gap width.

11. The closure of claim 10, wherein the distal end of the petal has a first width that is greater than the gap width such that the distal end cannot enter the gap by movement in the radial direction.

12. The closure of claim 10, wherein each inner lug includes a recess disposed between the front edge and the rear edge, and wherein the recess is disposed between an outer edge of the inner lug and an inner edge of the inner lug.

13. The closure of claim 1, wherein each outer lug of the plurality of outer lugs extends in the first axial direction such that the outer lug contacts the top wall of the of inner shell when the petal reaches its compressed height.

14. The closure of claim 1, wherein the outer shell further comprises an outer ring that depends from the top of the outer shell and extends in the first axial direction, and wherein the outer ring is configured to contact and abut the plurality of inner lugs when the petal reaches its compressed height.

15. The closure of claim 14, wherein each outer lug of the plurality of outer lugs extends in the first axial direction a first axial distance, wherein the outer ring extends in the first axial direction a second axial distance, wherein the inner ring extends in the first axial direction a third distance, and wherein the first axial distance is greater than the second axial distance.

16. The closure of claim 15, wherein the second distance is greater than the third distance.

17. The closure of claim 14, wherein the inner ring of the outer shell, the outer ring of the outer shell, and the outer side wall are concentric about a central axis.

18. The closure of claim 17, wherein the inner ring is disposed radially inwardly of the outer ring, and the outer ring is disposed radially inwardly of the outer side wall.

19. The closure of claim 1:

wherein the inner side wall includes an inner side wall distal end disposed opposite the inner shell top wall;

wherein the inner side wall distal end extends radially outwardly of the inner side wall;

wherein the outer side wall includes an outer side wall distal end disposed opposite the top of the outer shell;

wherein the outer side wall distal end extends radially inwardly;

wherein the outer side wall includes a recess adjacent the outer side wall distal end and extending in the first axial direction;

wherein the inner shell and outer shell are configured such that the inner side wall distal end extends radially outwardly into the recess when the inner shell and outer shell are coupled; and wherein the recess is adjacent the outer side wall distal end, and wherein the recess extends in the first axial direction a distance that is equal to or greater than the difference in the resting height and compressed height of the petal such that the inner side wall distal end may move in the first axial direction within the recess when the outer shell moves between the engaged position and the disengaged position relative to the inner shell.

20. The closure of claim 1, wherein the at least one petal includes at least four petals, and each petal of the at least four petals is equally spaced.

* * * * *